US011025002B1

(12) United States Patent
Zhang et al.

(10) Patent No.: US 11,025,002 B1
(45) Date of Patent: Jun. 1, 2021

(54) MAGNETIC CABLE ADAPTERS AND CONNECTORS AND METHODS OF INSTALLING CABLES IMPLEMENTING SAME

(71) Applicant: Google LLC, Mountain View, CA (US)

(72) Inventors: Xiaoyang Zhang, Mountain View, CA (US); Toby Xu, Mountain View, CA (US); Frederick Patton Mondale, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/681,339

(22) Filed: Nov. 12, 2019

(51) Int. Cl.

| | |
|---|---|
| ***H01R 13/62*** | (2006.01) |
| ***H01R 13/426*** | (2006.01) |
| ***H01R 13/627*** | (2006.01) |
| ***H01R 13/646*** | (2011.01) |
| ***H01R 13/436*** | (2006.01) |

(52) U.S. Cl.
CPC ..... *H01R 13/6205* (2013.01); *H01R 13/426* (2013.01); *H01R 13/436* (2013.01); *H01R 13/6272* (2013.01); *H01R 13/646* (2013.01); *H01R 2201/04* (2013.01)

(58) Field of Classification Search
CPC ..... H01R 13/6205
See application file for complete search history.

(56) References Cited

U.S. PATENT DOCUMENTS

| | | | | |
|---|---|---|---|---|
| 7,901,216 | B2 | 3/2011 | Rohrbach et al. | |
| 7,963,773 | B2 | 6/2011 | Palli et al. | |
| 8,342,857 | B2 | 1/2013 | Palli et al. | |
| 8,702,444 | B2 * | 4/2014 | Maranto | H01R 13/5825 439/467 |
| 2009/0269943 | A1 | 10/2009 | Palli et al. | |
| 2011/0136350 | A1 | 6/2011 | Palli et al. | |
| 2017/0317447 | A1 * | 11/2017 | Chen | H01R 13/6205 |

FOREIGN PATENT DOCUMENTS

DE 102016117204 A1 3/2018

OTHER PUBLICATIONS

Rosenberger Hochfrequentztechnik GmbH & Co. KG, Innovative Magnetic Connector Solution for Ethernet Connections (2018).
Partial European Search Report for European Patent Application No. 20206884.7 dated Mar. 9, 2021. 18 pages.

* cited by examiner

*Primary Examiner* — Ross N Gushi
(74) *Attorney, Agent, or Firm* — Lerner, David, Littenberg, Krumholz & Mentlik, LLP

(57) ABSTRACT

A magnetic adapter for a cable connector includes a main body having an opening, a compression surface exposed within the opening and configured to compress a biasing retention clip of the cable connector, at least one locking surface configured to secure the biasing retention clip in a second non-locking position; and at least one magnet adjacent the opening. When the biasing retention clip is positioned within the opening, the compression surface causes the biasing retention clip to move from a first locking position where the retention clip is in a fully biased position to the second non-locking position where the retention clip is compressed.

17 Claims, 16 Drawing Sheets

600

650

MAGNETIC CABLE ADAPTERS AND CONNECTORS AND METHODS OF INSTALLING CABLES IMPLEMENTING SAME

FIELD OF THE DISCLOSURE

The present application relates generally to devices and methods for establishing a physical connection between a cable connector and a port of a computing component, as well as achieving automated physical connection of cable connectors to corresponding ports of computing components.

BACKGROUND

Corporations operating large-scale computing systems invest significant amounts of capital to establish and maintain the hardware necessary to house the computing systems. For example, some computing systems may include a plurality of racks for holding computing components such as hard drives or entire servers.

One of the drawbacks to maintaining such servers is the man power required to physically connect cables, such as network and ethernet cables, to the ports of the respective computing components in the server rack. The conventional design of the latch connector or retention clip at the end of the cable requires the latch or retention clip to be physically compressed in order to install the cable into the port or to remove it from the port. However, current automated procedures do not have the capability to perform the step of compressing the latch. Requiring a person to physically connect and remove such cable connections from ports decreases productivity and increases overall cost.

Similar drawbacks can be seen in other applications requiring connection of a conventional cable connector latch design with a port. For example, it can be more difficult to attach telephone line connections and personal computer connections that require use of a latch connector.

Thus, improvements are needed to provide greater ease with connecting cables.

BRIEF SUMMARY

According to aspects of the disclosure, a magnetic adapter for a cable connector includes a main body having an opening, a compression surface exposed within the opening and configured to compress a biasing retention clip of the cable connector, at least one locking surface configured to secure the biasing retention clip in a second non-locking position; and at least one magnet adjacent the opening. When the biasing retention clip is positioned within the opening, the compression surface causes the biasing retention clip to move from a first locking position where the retention clip is in a fully biased position to the second non-locking position where the retention clip is compressed.

In one example of this aspect, the compression surface includes an angled surface.

In another example of this aspect, a first width of the opening is smaller than a second width of the cable connector.

In yet another example of this aspect, the opening is a first opening and the magnetic adapter further includes a second opening that has a second width greater than a first width of the first opening.

In still another example of this aspect, a locking surface engages a rear surface of the retention clip to inhibit movement of the retention clip.

In another example of this aspect, the cable connector extends beyond an outer surface of the magnetic adapter.

In another example of this aspect, the magnetic adapter is a monolithic structure or is alternatively comprised of at least two components that together form the magnetic adapter.

According to another aspect of the disclosure, a magnetic connector for an ethernet cable includes a main body, a connector tip and at least one magnet. The connector tip extends away from the main body and is configured to establish a data connection with an external port. The at least one magnet may be positioned within the main body to magnetically secure the main body to the external port.

In one example of this aspect, the main body and connector tip are integrally formed. Alternatively, the main body and the connector tip are manufactured as separate structural components.

In another example of this aspect, the connector tip is a latchless connector tip.

In yet another example of this aspect, the at least one magnet overlies the connector tip. Alternatively, the at least one magnet includes two magnets, and a second magnet underlies the connector tip.

In still another example of this aspect, the external port may be configured to receive a latchless connector tip. Alternatively, the external port may be configured to receive a connector tip with a latch thereon.

According to another aspect of the disclosure, an automated method for attaching a retention clip cable connector of a cable to a port of a computing component, includes providing a magnetic adapter removably attached to the retention clip cable connector, wherein the magnetic adapter is configured to compress a retention clip on the cable connector of the cable; connecting a robotic arm with the magnetic adapter; guiding the magnetic adapter, using the robotic arm, to a port opening of a computing component; and inserting the cable connector into the port opening of the computing component so as to magnetically secure the magnetic adapter to the computing component and establish a data connection with the computing component.

In still another example of this aspect, the retention clip cable connector is a cable connector for an ethernet cable.

In yet another example of this aspect, the method further includes connecting the robotic arm includes connecting the robotic arm with recesses on the magnetic adapter.

In still another example, the method further includes removing the cable connector from the port opening by overcoming a magnetic force used to secure the cable connector to the port opening.

It is to be noted that the features of the above-described arrangements are not exclusive to each other, and that any one of such features and arrangements can be combined with one or more of the other features and arrangements to arrive at further aspects of the disclosure.

BRIEF DESCRIPTION OF THE DRAWINGS

A more complete appreciation of the subject matter of the present disclosure may be realized by reference to the following detailed description and the accompanying drawings, in which.

DETAILED DESCRIPTION

Figure 1:
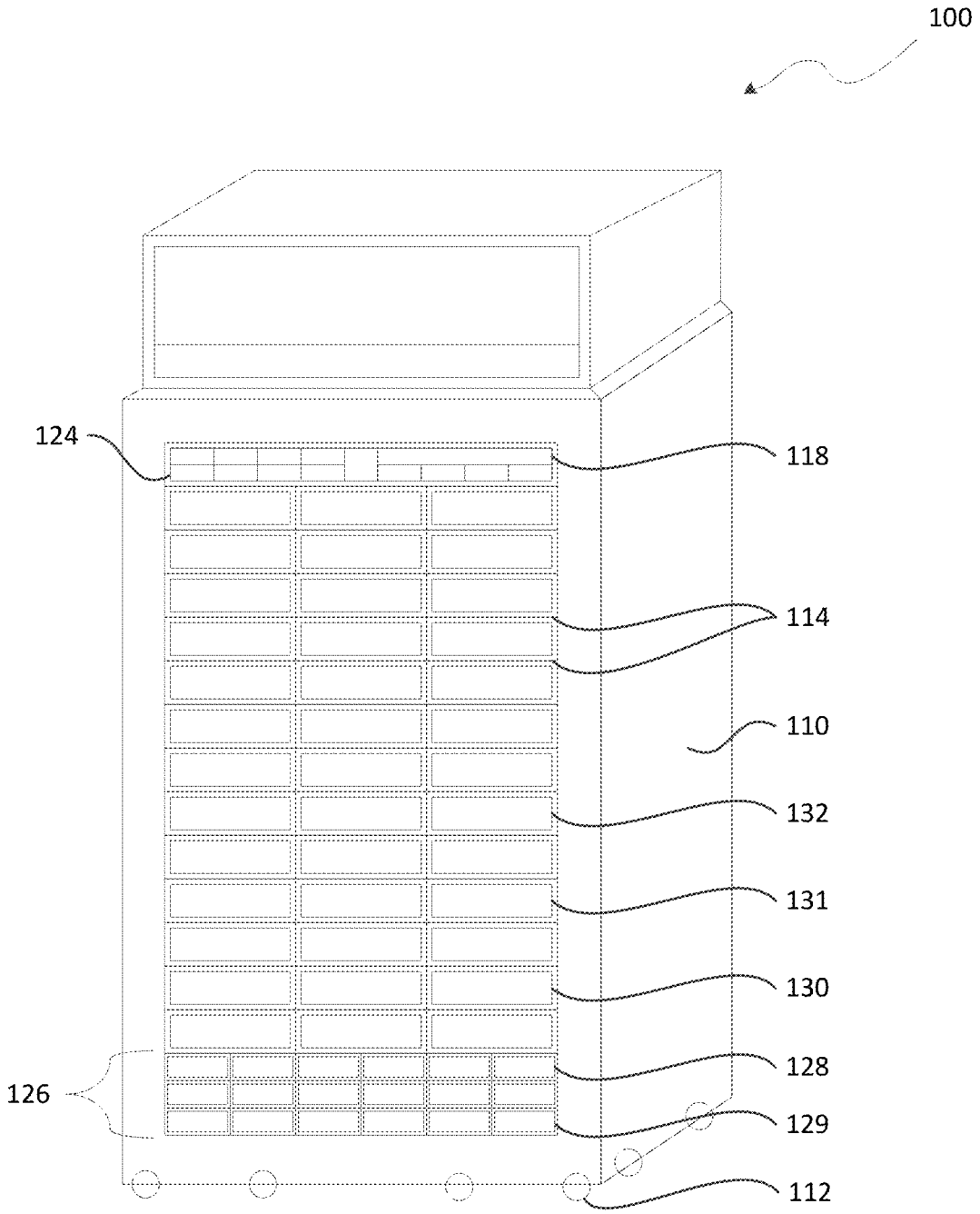
FIG. 1 is an example server rack according to an aspect of the disclosure.

The present disclosure is directed to methods and devices for providing a magnetic connection between a cable connector and a port, as opposed to using a retention clip or latch required in conventional cable to port connections. This can allow for an automated process of both installing and removing cables from corresponding ports or jacks of a computing component, as well as enhance user experience when establishing connections for personal computing devices. In one example, a magnetic adapter used together with a conventional cable connector allows for a direct and magnetic connection of the cable with a port of a computing device. The magnetic adapter adapts the conventional retention clip or latch locking mechanism connector to a magnetic locking connector. The magnetic adapter can establish a removably secure connection between the cable and computing component. In another example, a modified magnetic cable connector that does not include the conventional latch locking mechanism can be attached to a port that requires a conventional latch connector, as well as a port that may be modified to not require a latch connector. Such cable connector allows for the cable to be directly attached and magnetically secured to a port or jack of a computing component.

Overview

Establishing a magnetic and latchless connection between a cable connector and a port can be accomplished in at least two ways according to aspects of the disclosure: use of a magnetic adapter with a conventional cable and use of a magnetic cable connector with a modified cable connector that does not include a latch or retention clip. Turning first to a magnetic adapter, the magnetic adapter can be attached to a conventional cable connector to provide for a magnetic connection between a cable and a port. In one example, a magnetic adapter may include an opening that is large enough to receive a magnetic cable connector. A compression surface may be positioned and exposed within the opening to depress a latch or retention clip of a cable connector as the magnetic adapter moves over the cable connector. The opening can lead to a second larger opening that is sized to receive the magnetic cable connector and allow for a reduction in the compression force applied onto the latch or retention clip, so that the retention clip may move into an expanded position. The magnetic adapter can include a first stopping surface that can abut a top rear edge of the retention clip, as well as a second stopping surface that can abut the bottom edge of the connector.

To achieve a magnetic connection, in one example, the magnetic adapter can be joined with the cable connector. The cable connector can pass through the opening at one end of the magnetic adapter. As the cable connector passes through the opening, the latch or retention clip can engage the compression surface of the opening. This causes the retention clip to move into a compressed state. As the cable connector continues to pass through the opening, the retention clip can be slightly released from the compressed state as the connector passes through to the second larger opening. Once the connector is positioned within the second opening, the connector can be secured within the adapter. Once the connector is positioned within the adapter, the connector can now be directly and removably secured to a computing component.

Use of a modified magnetic cable connector can provide an alternative device for achieving a magnetic and latchless cable connection between a cable, such as a data cable or telephone cable, and a corresponding port, such as a data port. According to aspects of the disclosure, a modified cable connector will not include a biasing latch or retention clip, but instead includes one or more magnets incorporated directly into the housing of the cable connector.

The magnetic adapter and the modified magnetic cable connector can allow for easy attachment of a cable to a corresponding jack or port of a computing component, as well as easy removal of the cable from the port of the computing component. Additionally, by changing the locking mechanism from a biasing latch mechanism or retention clip to a magnetic locking mechanism, the attachment and removal of the connectors and cables can be automated and generally provide for a better user experience. For example, a robotic arm can be utilized to attach a conventional cable with attached magnetic adapter, or alternatively a modified magnetic connector of a cable, to a port of a computing component.

Example Server System

FIG. 1 depicts a server system 100 that may include a rack 110 having wheels 112, a plurality of shelves 114 for holding components, a rack monitoring unit (RMU) 118 for monitoring the status of the features of the rack, a plurality of rectifiers 124, a battery backup 126, battery boxes 128, 129, and a plurality of computing components 130-132. Computing components 130-132 can include servers, computers, and the like.

Server system 100 supplies power from a power source to the computing components 130-132. For example, though not shown in the figures, each of the shelves of the rack may be connected to a power supply, such as an AC or DC power source, by way of main bus bar (not shown). Main bus bar may also be connected to each shelf of the rack in order to provide power and data to the components or battery boxes.

Figure 2:
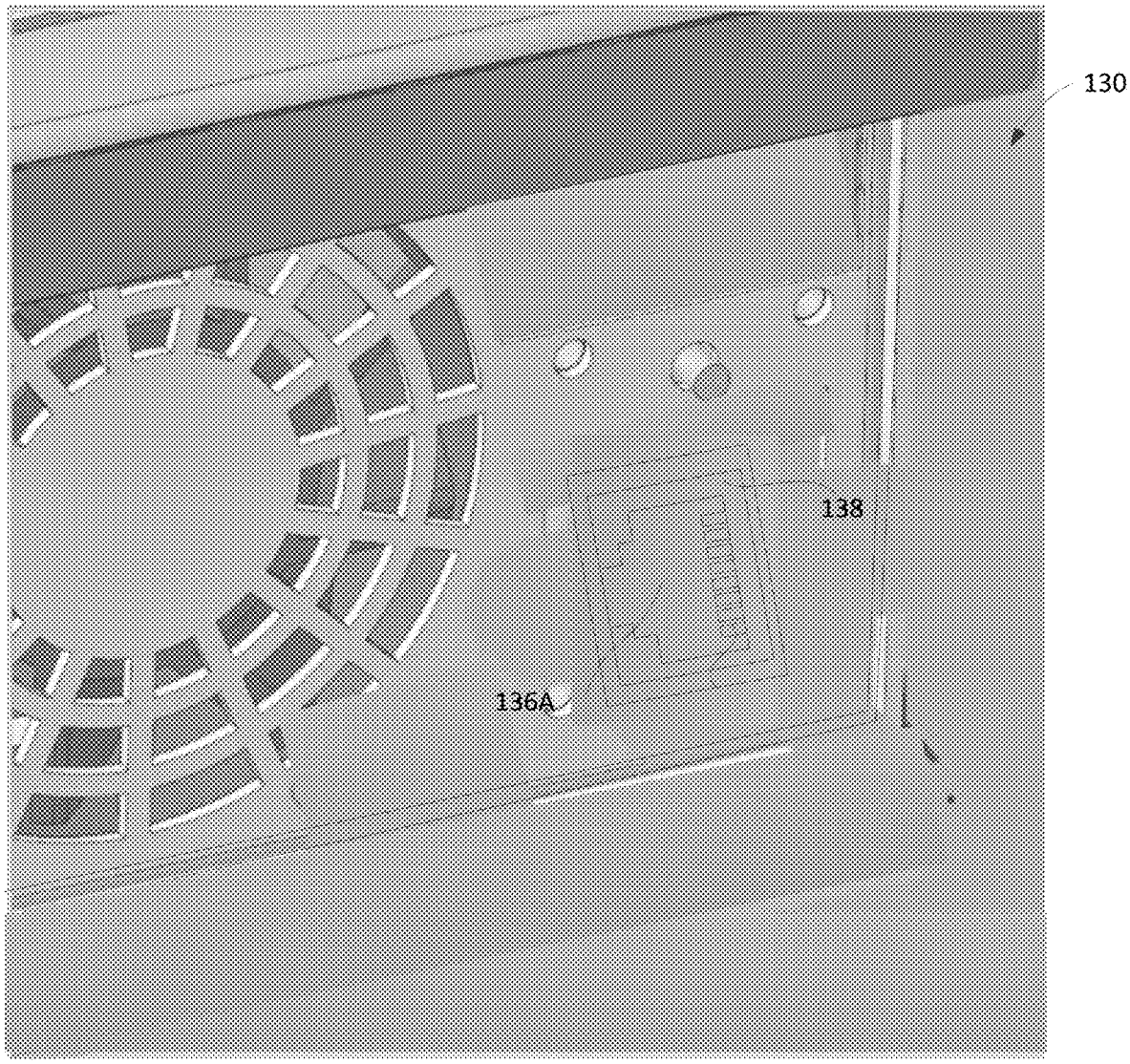
FIG. 2 an enlarged perspective view of a portion of a computing component according to an aspect of the disclosure.

Computing components 130-132 may further include jacks, sockets or ports for receiving cable connectors of data cables and the like. For example, FIG. 2 illustrates an enlarged portion of one of the computing components 130-132, such as computing component 130. One or more ports 136 may be positioned within computing component. An example port 136 may be an ethernet port to connect wired network hardware in an ethernet LAN, metropolitan area network (MAN), wide area network (WAN) or the like. Port 136 may be a conventional ethernet port that includes eight pins 138 configured to receive a RJ45 ethernet cable connection. In other examples, alternative types of ports may be utilized, such as video, network, serial management, network, management, alternative ethernet ports and the like. Multiple ports may be present in one or more locations of the computing devices 130-132 present in the server system.

Example Magnetic Adapter

Figure 3:
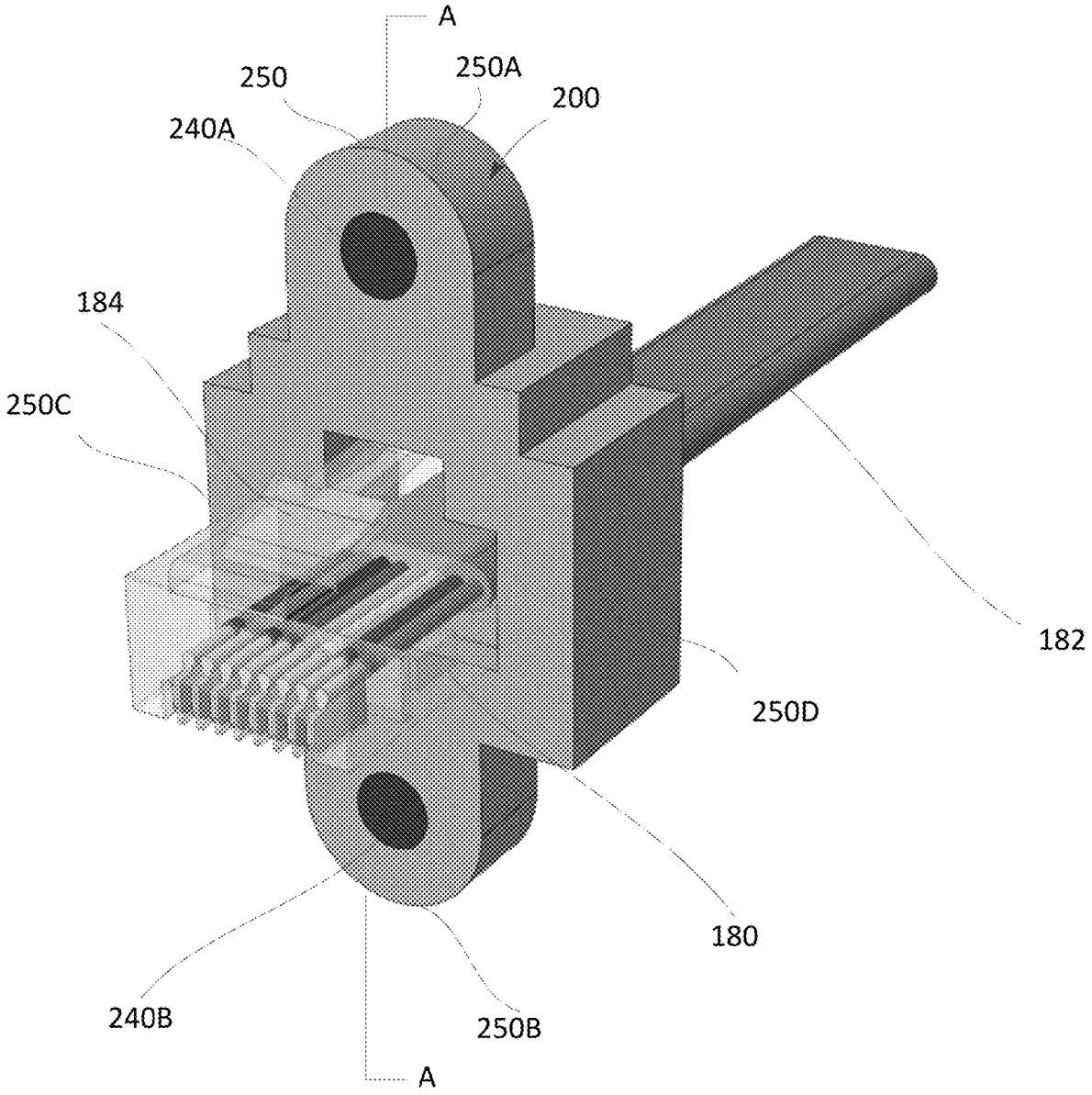
FIG. 3 is a perspective view of a magnetic adapter according to aspects of the disclosure, attached to a conventional cable.

With reference to FIG. 3, an example magnetic adapter 200 according to aspects of the disclosure is illustrated. Magnetic adapter 200 is shown removably joined to a conventional cable connector 180 for a cable 182. In this example, conventional cable 182 is a RJ45 Ethernet cable that includes an 8 pin cable connector 180. But, in other examples, any type of cable and cable connector may be utilized or selected based on the type of port to which a cable will be connected. Connector 180 includes a retention clip or latch 184 that is conventionally known to secure connector 180 within a jack or port of a computing component. Retention clip or latch 184 may be a biasing mechanism that conventionally secures connector 180 within a port. When installing connector 180 within a port, latch 184 must be compressed to allow cable connector 180 to fit into a port. Once the connector is positioned within a port, release of the latch 184 allows latch 184 to bias to a fully open and locked position within the port. As will be disclosed herein, magnetic adapter 200 obviates the need for a user to be the one to physically compress latch 184 and release latch 184 when connecting and securing connector 180 of cable 182 to a port.

Magnetic adaptor 200 may include a main body 250 that is be a monolithic and unitary component, but in other examples, the main body 250 of magnetic adapter 200 may be a multi-piece component. Magnetic adapter 200 may be a rigid component that is durable and strong enough to secure a cable connector therein, as well as allow for the cable connector 180 to be joined to and removed from a port on multiple occasions. Magnetic adaptor 200 may take on a variety of shapes and sizes. In this example, a central portion of magnetic adapter is shown as being square in shape, with the outermost upper and lower limits of magnetic adapter 200 being circular in shape. Alternative shapes may also be implemented. For example, magnetic adapter may be fully square, rectangular, circular, triangular or combinations of these and/or other shapes. Magnetic adapter 200 need only be large enough and possess a shape that allows magnetic adapter to extend around the periphery of connector tip 452, as well as include magnets.

Various materials can be used to manufacture magnetic adapter 200, including plastic materials, such as PETE, HDPR, PP, and the like. Adapter 200 can also be comprised of a metal or combination of metal and plastic, or any other types of suitable material.

Figure 4:
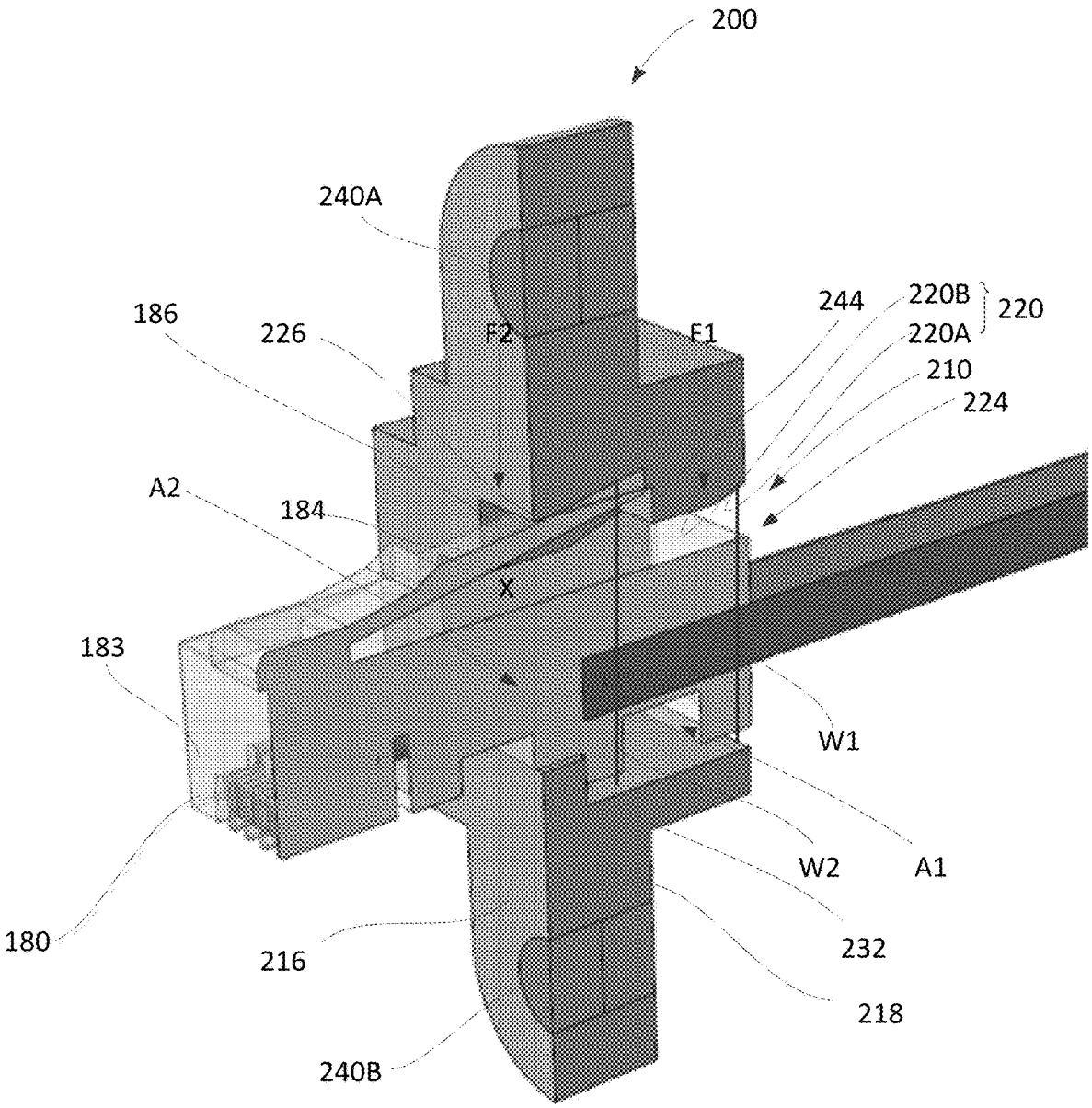
FIG. 4 is a cross-sectional perspective view taken along line A-A of FIG. 3.

FIG. 4 illustrates a cross-sectional perspective view of magnetic adapter 200 and connector 180. An opening 210 extends through the front surface 216 and rear surface 218 of magnetic adapter 200, such that the opening 210 extends through an entirety of magnetic adapter 200. The opening 210 has a first width W1 adjacent the rear surface 218, but opens up to a larger width W2 adjacent the front surface 216. The first width W1 can define a first area A1 within opening 210 and the larger width W2 can define a second area A2 within the opening 210. Opening 210 is sized to allow for a cable connector to extend therethrough.

Magnetic adapter 200 may include a latch compression surface to compress latch portions of a cable connector. In one example, a first latch compression surface 220 is formed adjacent the rear surface 218 of magnetic adapter 200 and at the entrance 224 to opening 210 where a cable connector will be introduced into the magnetic adapter 200. First latch compression surface 220 may include an angled surface portion 220A that is angled relative to the planar wall surfaces 220B of the remainder of the first compression surface 220. Providing angled surface portion 220A allows for a more gradual transition of a cable connector into the opening 210 during compression of the latch of a cable connector. In other examples, angled surface portion 220A need not be provided and a planar surface can be provided that will compress the latch of a connector.

Second area A2 of opening 210 includes locking surfaces to secure a connector within the magnetic adapter. First locking surface 230 may be an interior edge positioned adjacent front surface 216 of magnetic adapter 200. Second locking surface 232 (FIG. 4) may be provided at an interior edge surface between the first locking surface and the first compression surface 220.

Magnets may be provided on the main body 250 of the magnetic adapter 200 to secure magnetic adapter 200 to a computing device. Any number and type of magnets can be provided to achieve connection between the magnetic adapter 200 and a computing component. In one example, magnets 240A, 240B are provided adjacent outermost edges of magnetic adapter 200. With reference back to FIG. 3, two magnets 240A, 240B are shown positioned toward the respective top edge 250A and bottom edge 250B of magnetic adapter 200. In other examples, a single magnet may extend around a periphery of connector 180, including adjacent the left edge 250C and right edge 250D of magnetic adapter 200. Alternatively, four magnets may be positioned around the top and bottom edges 250A, 250B, as well as adjacent right and left edges 250D, 250C of magnetic adapter 200. Still further, two magnets may instead be positioned adjacent the right edge 250D and left edge 250C of magnetic adapter 200.

To physically join the cable connector and magnetic adapter 200 together, connector 180 may first be inserted into the entrance 224 of opening 210. (See FIG. 4.) As magnetic adapter 200 slides over front end 183 of connector 180, first compression surface 220 contacts latch 184. Angled portion 220A of compression surface 220 first contacts latch 184 and causes latch 184 to apply a downward force F1 against the biasing force of latch 184. Downward force F1 causes the latch 184 to compress and reduce the overall distance X between latch 184 and top surface 186 of connector 180. Latch 184 continues to be compressed as it travels through the first area A1 of opening 210 and along the planar wall surface 220 B of first compression surface 220. Once connector 180 passes an edge 244 of first compression surface 220, the downward force F on latch 184 is released and latch 184 expands into its biased position. As shown, latch 184 will expand and fill second area A2 of opening 210 until top surface 186 of latch 184 contacts second compression surface 226. Second compression surface 226 provides a downward force F2 to maintain latch 184 in a compressed state and one that does not allow latch 184 to be in a fully biased and expanded position. It is to be noted that this compressed position is one that would not allow for latch 184 to be secured within a port, as discussed further below.

Figure 5:
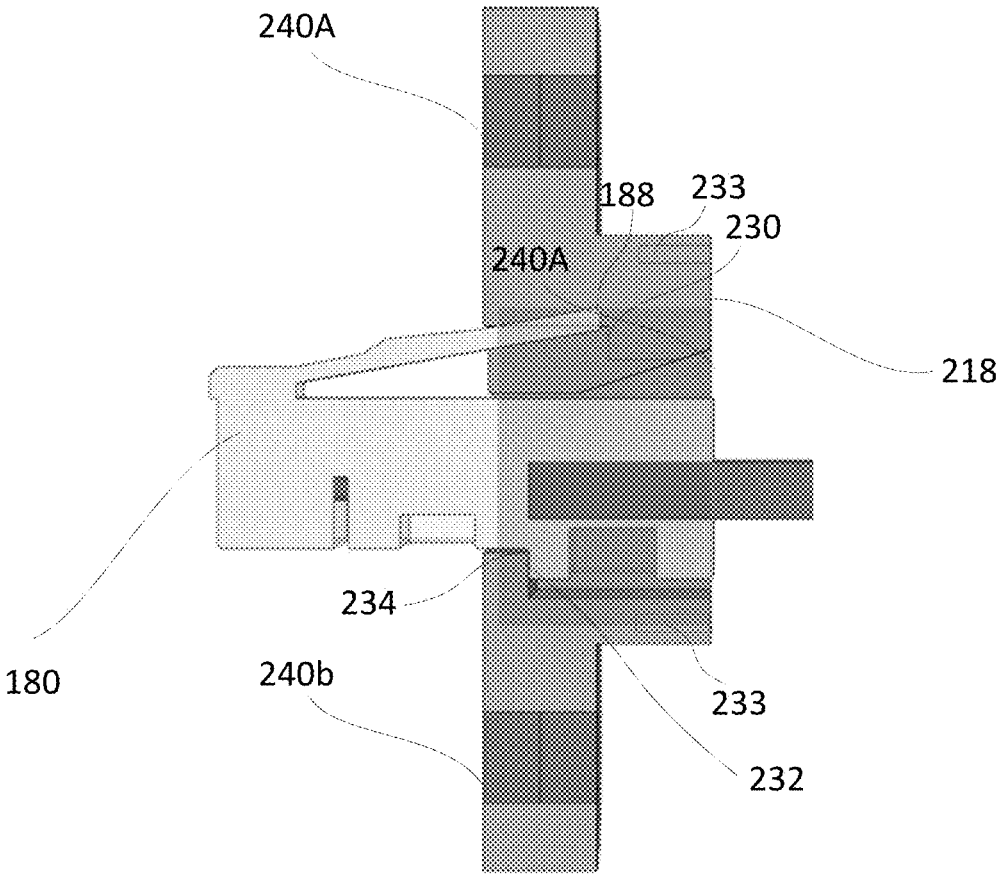
FIG. 5 is a cross-sectional view taken along line A-A of FIG. 3.
Figure 6:
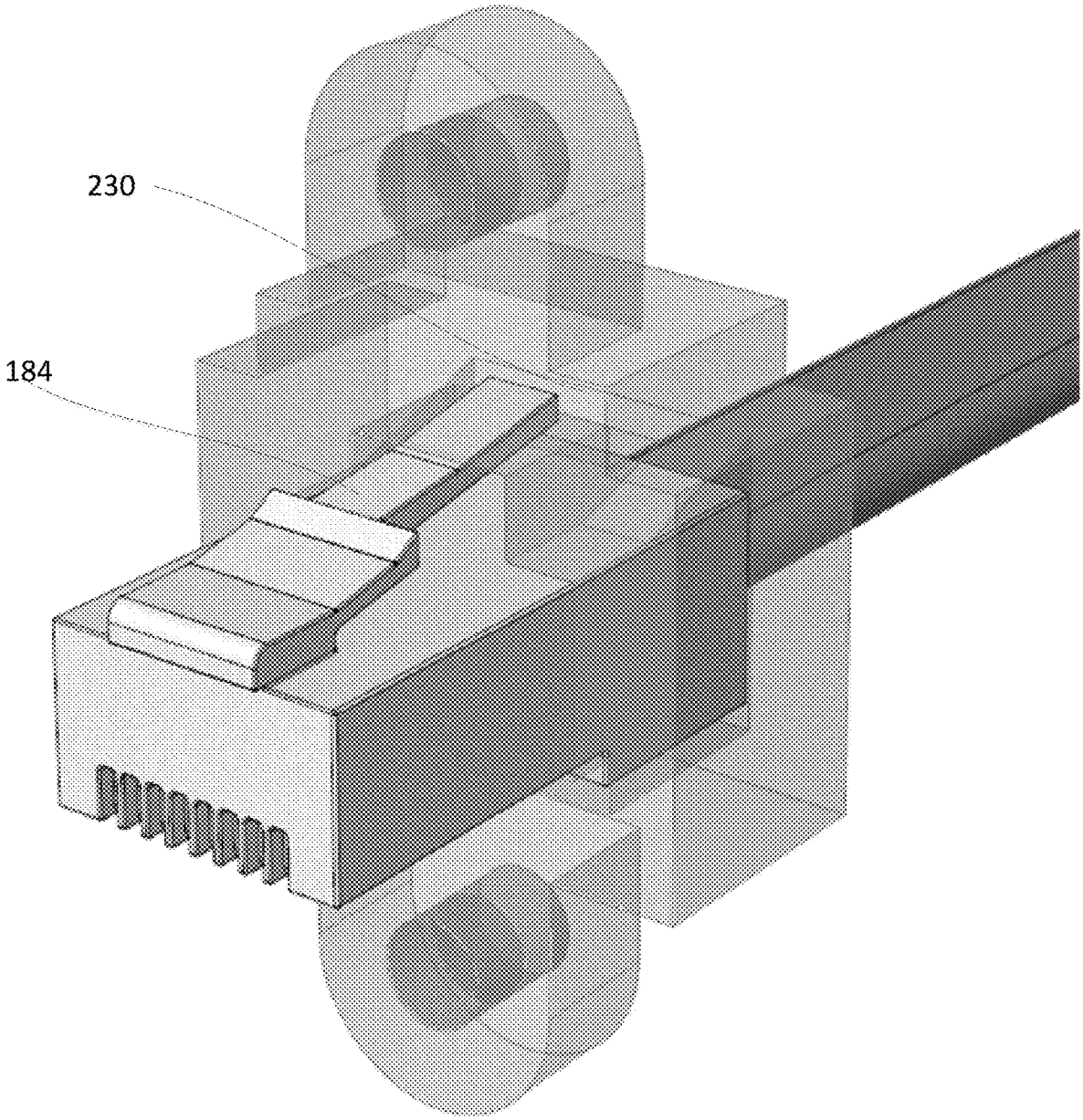
FIG. 6 is an enlarged and another perspective view of the cable and adaptor of FIG. 3, in which the magnetic adapter is shown as translucent to allow for features of the cable connector to be seen therethrough.

Referring to FIGS. 5-6, when latch 184 is positioned within the second area A2 of opening 210, connector 180 is secured within magnetic adapter 200. As shown, in this latch position, connector 180 is unable to be removed from opening 210. First locking surface 230 prevents lateral movement of latch 184 out of opening 210 in a direction toward rear surface 218 of magnetic adapter 200. For example, first locking surface 230 will engage rear edge surface 188 of latch 184 to prevent movement of connector 180. Second locking surface 232 prevents lateral movement of latch 184 out of opening 210 in a direction toward front surface 220 of magnetic adapter. Second locking surface 232 can engage a front surface 234 of a lower portion of connector 180. Without first compressing latch 140 so that connector 180 can be compressed to a smaller size and moved into first area A1 of opening 210, connector 180 remains secured within magnetic adapter 200 and cannot otherwise be removed from magnetic adapter without undue force.

Figure 7:
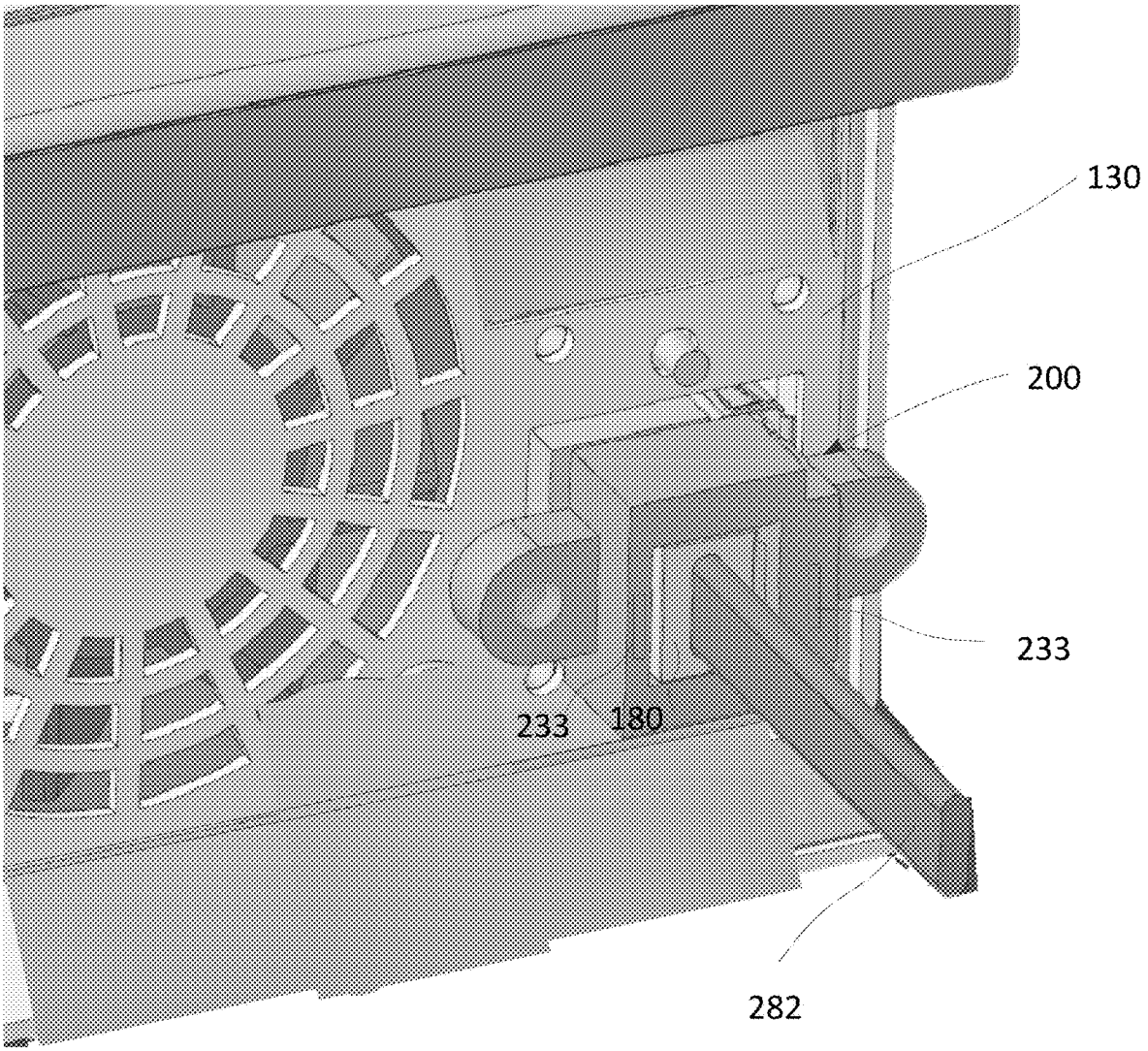
FIG. 7 is an enlarged perspective view of a portion of a computing component with the magnetic adapter and cable attached thereto according to aspects of the disclosure.

FIG. 7 is a perspective view of magnetic adapter 200 and cable 282 magnetically joined to port 136 (FIG. 2) of computing component 130. Magnetic adapter 200 maintains latch 184 (FIG. 6) in a partially compressed state, where latch 184 remains in an unlocked and unbiased position. In this compressed state, connector 180 can be placed directly into port 136 and a separate step of compressing latch 184 to position it within port 136 is now obviated. Once within port 136, magnetic adapter 200 prevents latch 184 from biasing to a fully locked position within port 136. Magnets will instead secure magnetic adapter 200 and latch 184 to port 136. As shown, magnets attach directly to the metal housing of computing component 130.

Figure 8:
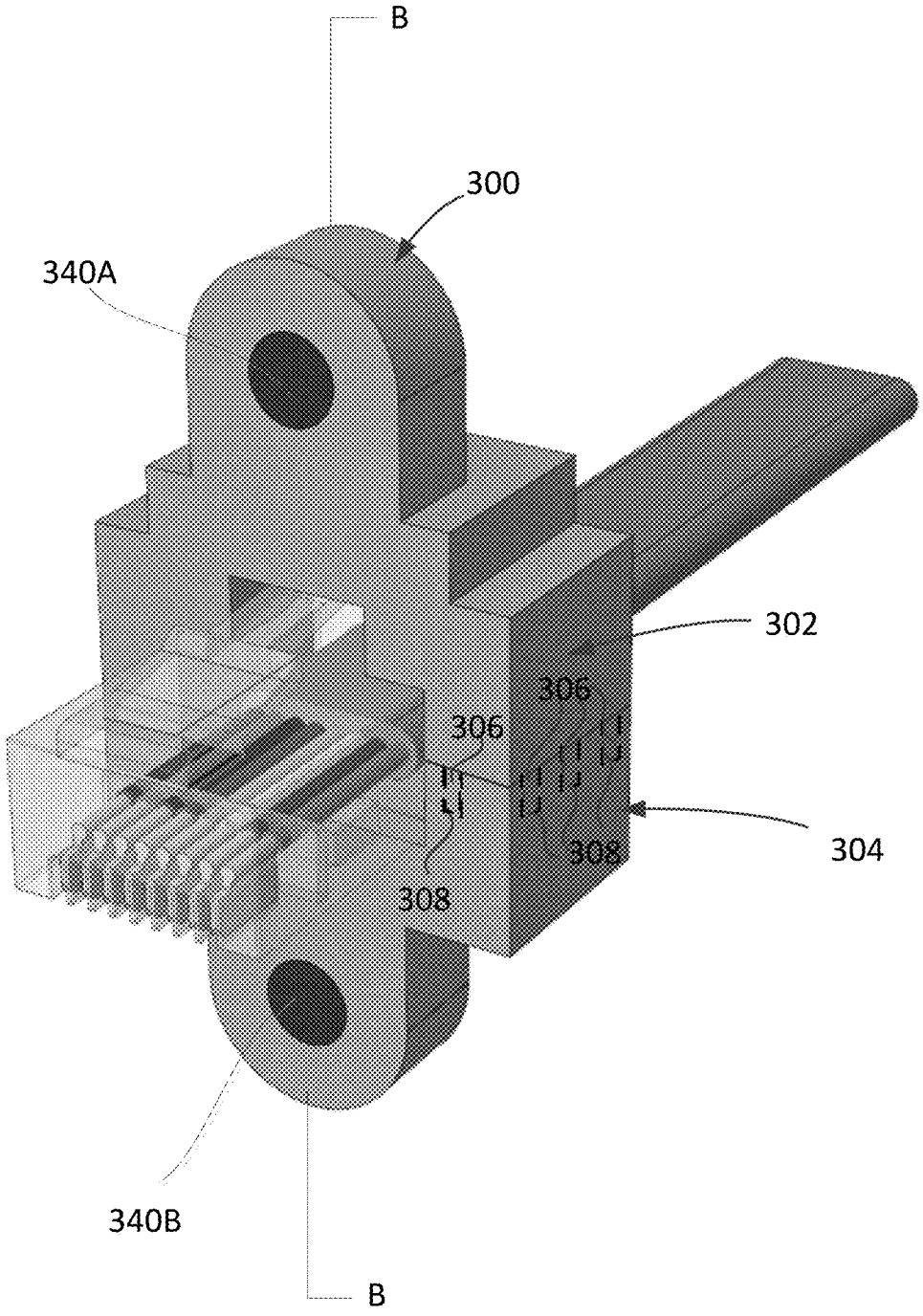
FIG. 8 is a perspective view of a cable and a magnetic adapter according to another aspect of the disclosure.
Figure 9:
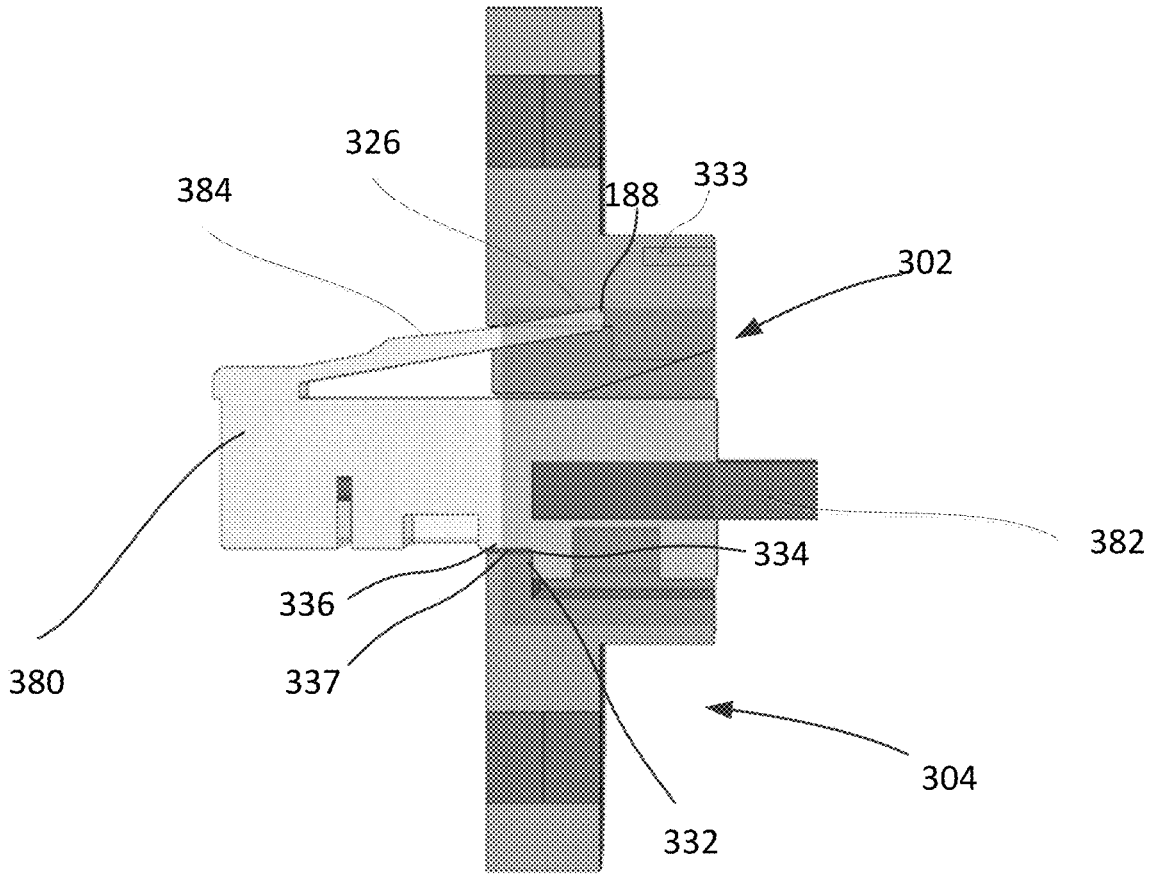
FIG. 9 is a cross-sectional view taken along line B-B of FIG. 8.

FIGS. 8-9 illustrate an alternative magnetic adapter 300 that includes magnets 340A, 340B. The difference between magnetic adapter 300 and magnetic adapter 200 is that magnetic adapter 300 is not a unitary monolithic component. Magnetic adapter 300 is composed of a first upper portion 302 and a second lower portion 304 that can be joined together using various methods. In one example, a first upper portion 302 may include pins 306 that protrude away from the first upper portion 302 and that are sized to fit into recesses 308 in the second lower portion 304. The pins 306 may be secured within the recesses using known methods. For example an adhesive can be used to join the first upper portion 302 and second lower portion 304 together. The recesses 308 and pins 306 may have an interference fit or the pins 306 may further include mechanical features that can interlock with the recess.

The first upper portion 302 and second lower portion 304 of magnetic adapter 300 can be assembled together around connector 380. For example, with reference to FIGS. 8-9, prior to assembly, second lower portion 304 may be disconnected from the first upper portion 302. Connector locking surface 334 of connector 380 can be positioned adjacent second adapter locking surface 332 of second lower portion 304 of magnetic adapter 300. Outer surface 336 of connector 380 can be positioned to overlie top surface 337 of magnetic adapter 300. Pins 306 of first upper portion 302 can then be aligned and then joined with recesses 308 in the second lower portion 304.

When the first upper portion 302 and second lower portion 304 are joined together around connector 380, compression surface 326 compresses latch 384 so that latch 384 cannot expand to its fully biased and open position. In the compressed position, connector 380 can be inserted directly into a port as previously described.

In other examples, the first upper portion 302 and second lower portion 304 may be joined together prior to insertion of cable 382. Cable 382 can then be inserted into magnetic adapter 300 and magnetic adapter 300 can slide over cable 382 to compress latch 384, as previously described.

Example Latchless and Magnetic Cable Connector

Figure 10:
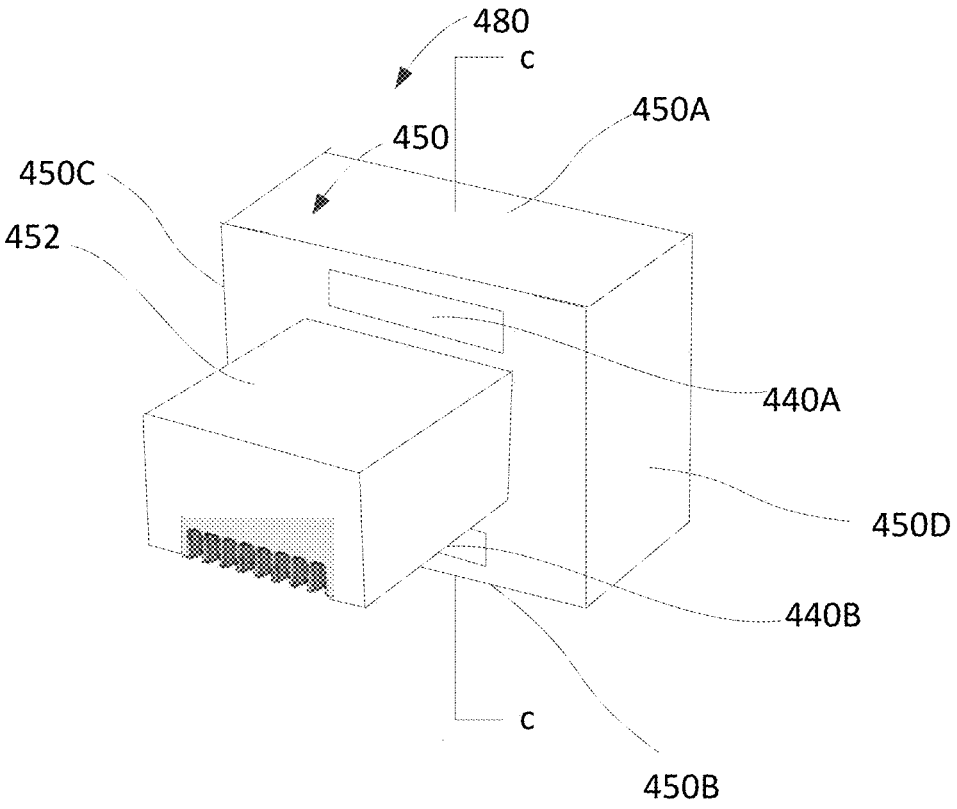
FIG. 10 is a perspective view of a cable connector for a cable according to aspects of the disclosure.
Figure 12:
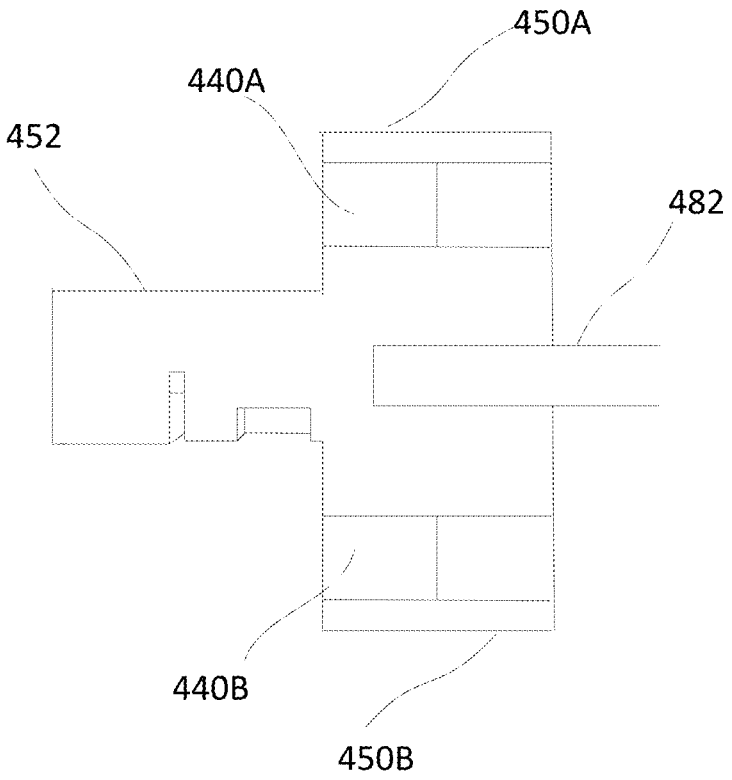
FIG. 12 is a cross-sectional view of the cable connector shown in FIG. 10, with a cable attached thereto.

According to another aspect of the disclosure, a latchless cable connector can be utilized to establish a connection between a cable and a port. With reference to FIG. 10, an example cable connector 480 is shown that does not include a latch and instead incorporates magnets directly into the connector housing. For example, connector 480 can include a main body 450 and a connector tip 452 that together form a single and monolithic component. Main body 450 and connector tip may be integrally formed as one component. In other examples, main body 450 and connector tip 452 may be separately manufactured and then joined together to form a unitary connector 480 using known methods, such as adhesive or including structural interlocking features on the main body 450 and connector tip 452. Connector 480 may be provided as a separate component. A cable 482 (FIG. 12) can be later attached to connector 480.

Connector 480 can be comprised of known materials. For example, various materials can be used, including plastic materials, such as PETE, HDPR, PP, and the like. Connector 480 can also be comprised of a metal or combination of metal and plastic, or any other types of suitable material. Main body 450 may be formed from the same material or a different material than connector tip 452.

Connector tip 482 of connector 480 can be designed to accommodate any number of pin connections. For example, connector 480 is shown as including 8 pins to provide for a RJ45 ethernet cable connection. In other examples, connector tip may by modified for different applications or connections, including those that may require fewer or a greater number of pins, or no pins at all.

Main body 450 may take on a variety of shapes. In this example, main body 450 is shown as being square in shape, but alternative shapes can also be implemented. For example, main body 450 may be rectangular, circular, triangular or combinations of such shapes. Main body 450 need only be large enough and possess a shape that allow main body 450 to extend around the periphery of connector tip 452, as well as include magnets.

Figure 11:
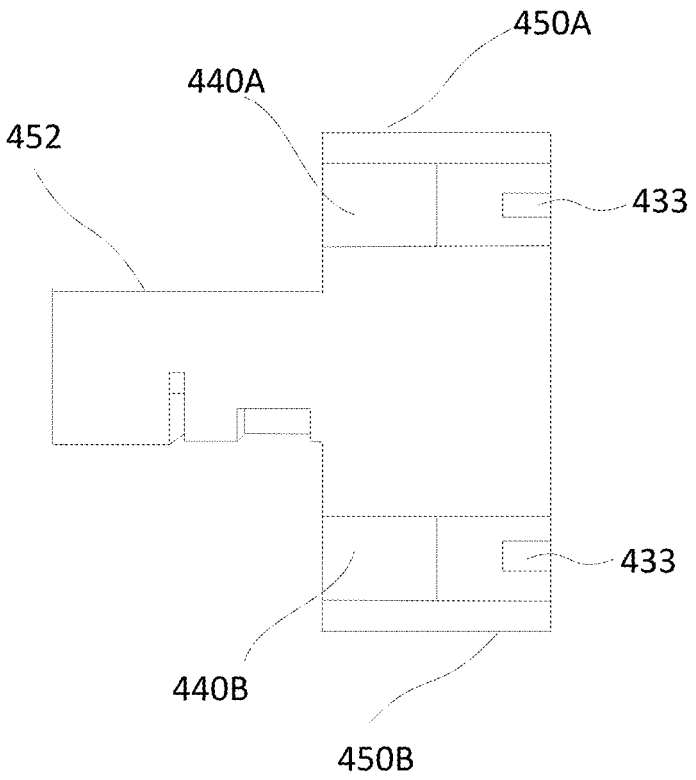
FIG. 11 is a cross-sectional view taken along line C-C of FIG. 10.

Connector tip 452 protrudes away from main body 450. Connector tip 452 may otherwise be a conventional tip 452 that can directly connect with a port and allow for the exchange of data, power and the like. In this example, tip 452 includes 8 pins and is intended to form an Ethernet connection, such as a RJ45 connector. But, any pin configuration or other types of configurations may be utilized for a particular application. As shown in the cross-sectional view of FIG. 11, other than omission of a latch, tip 452 can otherwise be identical to conventional connector tips 452, such as a RJ45 cable connector tip. This will allow for use of connector 480 within any standard port.

Any number of magnets may be positioned at different locations on main body 450. In this example, two magnets 440A, 440B are shown positioned toward the top edge 450A and bottom edge 450B of main body 450. In other examples, a single magnet may extend around a periphery of connector tip 452, including adjacent the left edge 450C and right edge 450D of main body 450. Alternatively, four magnets may be positioned around the top and bottom surfaces of main body 450, as well as adjacent right and left edge surfaces of main body 450. Still further, two magnets may instead be positioned adjacent the right edge 450D and left edge 450C of main body 450.

Magnet 440A or 440B, and the number of magnets can be selected based upon the desired magnitude of the magnets 440. In one example, the magnets can be selected that strike a balance between providing ease of removal of connector 452 from a port by a user and being strong enough to secure the cable 482 and connector tip 452 to a computing component and to prevent inadvertent removal of connector 452.

Figure 13:
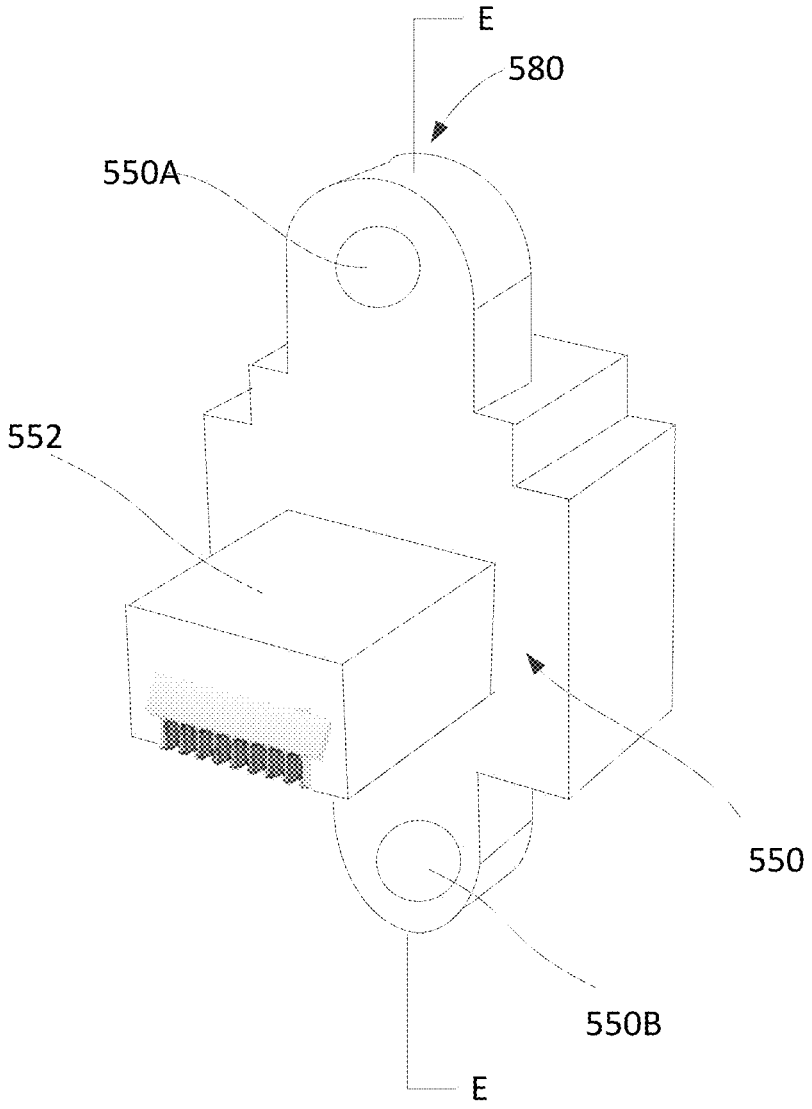
FIG. 13 is a perspective view of a cable connector of a cable according to another aspect of the disclosure.
Figure 14:
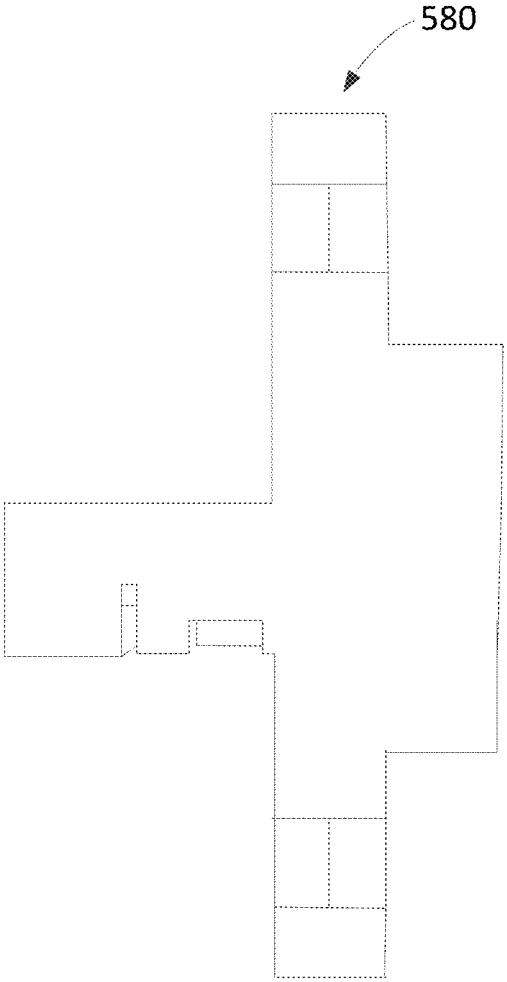
FIG. 14 is a cross-sectional view taken along line E-E of FIG. 13.

FIGS. 13-14 provide another example magnetic connector 580, which can be joined to cable (not shown). In this example, magnetic connector 580 includes a main body or housing 550 and a connector tip 552, as well as magnets 550A, 550B. Together, housing 550 and connector tip 452 form a unitary magnetic connector 580. Connector 552 is shown as being capable of providing an 8 pin connection, such as for a RJ45 ethernet cable, but connector 552 can be modified to accommodate any number of desired pins. A cable (not shown) can be later connected to magnetic connector 580 using conventional methods of attachment. For example, as previously disclosed herein, a RJ45 ethernet cable can be utilized in connection with magnetic connector 580.

The only difference from magnetic connector 480 is the shape of the main body 550. In this example, a central portion of magnetic connector 580 adapter is shown as being square in shape, with the outermost upper and lower limits of magnetic adapter 200 being circular in shape. Alternative shapes may also be implemented.

Example Methods of Connecting Magnetic Adapter/Connectors

According to another aspect of the disclosure, use of magnetic adapters or modified cable connectors, as disclosed herein, simplifies the installation process and makes it easy for a user or a robot to secure cable 182 within port 136, as well as remove cable 182 from port 136. Magnetic adapter 200 allows for use of conventional cables and obviates the need for a user or robot to both compress latch 184 prior insertion of connector 180 within a port and release latch 184 to a biasing position once positioned within a port. A robotic arm can be programmed to connect cable 182 and magnetic adapter 200 directly to a port. The robotic arm may be controlled by a separate control device. For example, a robotic arm (not shown) can hold a magnetic adapter 200 with attached cable 182. Magnetic adapter 200 can include recesses 233 (FIG. 5) to which robotic arm can attach. The robotic arm can then guide and then insert the connector 180 directly into port 136. Magnets 240A, 240B on the magnetic adapter can secure cable 182 and connector 180 to port 136. When it is desired to remove cable 182 from the port of the computing component, a robotic arm or the like can apply a force to overcome the magnetic force holding magnetic adapter 200 in place and remove the cable 182 from the port. Cable 182 may then be replaced by another cable to be inserted by the same robotic arm or another robotic arm.

Similarly, when it is desired to connect to a server using a modified cable connector, a robotic arm may also be utilized. A robotic arm can be programmed to connect a cable 482 with modified cable connector 480 directly to a port. For example, a robotic arm (not shown) can removably attach to recesses 433 in main body 450 of magnetic connector. Robotic arm can guide and align main body 450 of magnetic connector 480 with the attached cable 482 with a port or jack. Robotic arm may then insert cable connector 480 into the port opening. Edge surface of main body 450 can prevent the connector tip 452 from moving too far inside of the port opening and damaging the port. The magnets within the main body 450 can then be removably and magnetically attached to the computing component, thereby achieving a secure hold between connector 480 and computing component.

Figure 15:
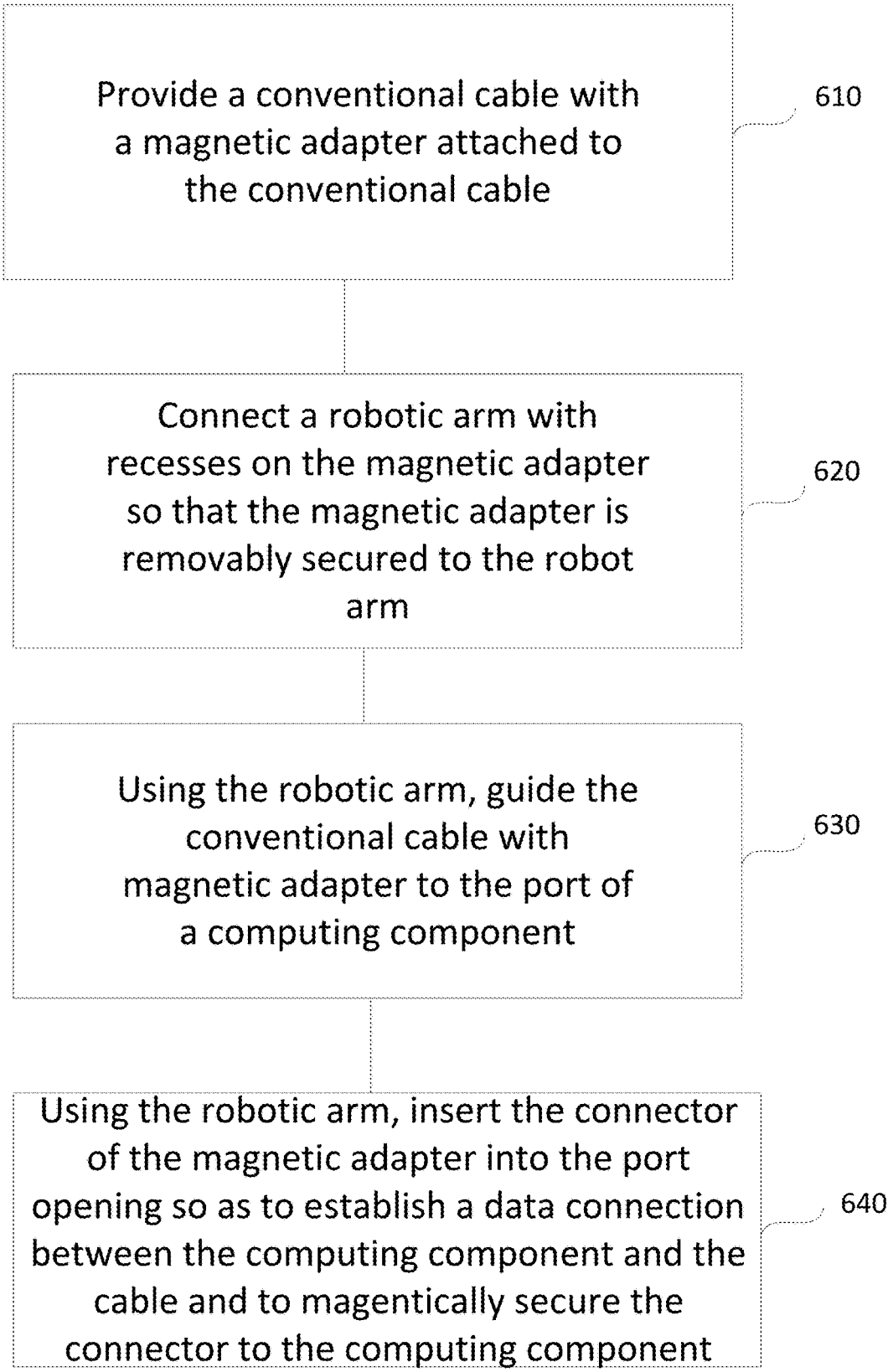
FIG. 15 is a method of automation for securing a magnetic adapter and cable to a computing component.

Turning to FIG. 15, an example method 600 for magnetically securing a conventional connector to a port of a computing component and establishing a data connection is shown. At box 610, a conventional cable with a magnetic adapter attached to the conventional cable is provided. At box 620, a robotic arm may be connected with the magnetic adapter so that the magnetic adapter is removably secured to the robotic arm. At box 630, using the robotic arm, the conventional cable with magnetic adapter can be guided to the port of a computing component. At box 640, the connector of the magnetic adapter may be inserted into the port opening so as to establish a data connection between the computing component and the cable and to magnetically secure the connector to the computing component.

Figure 16:
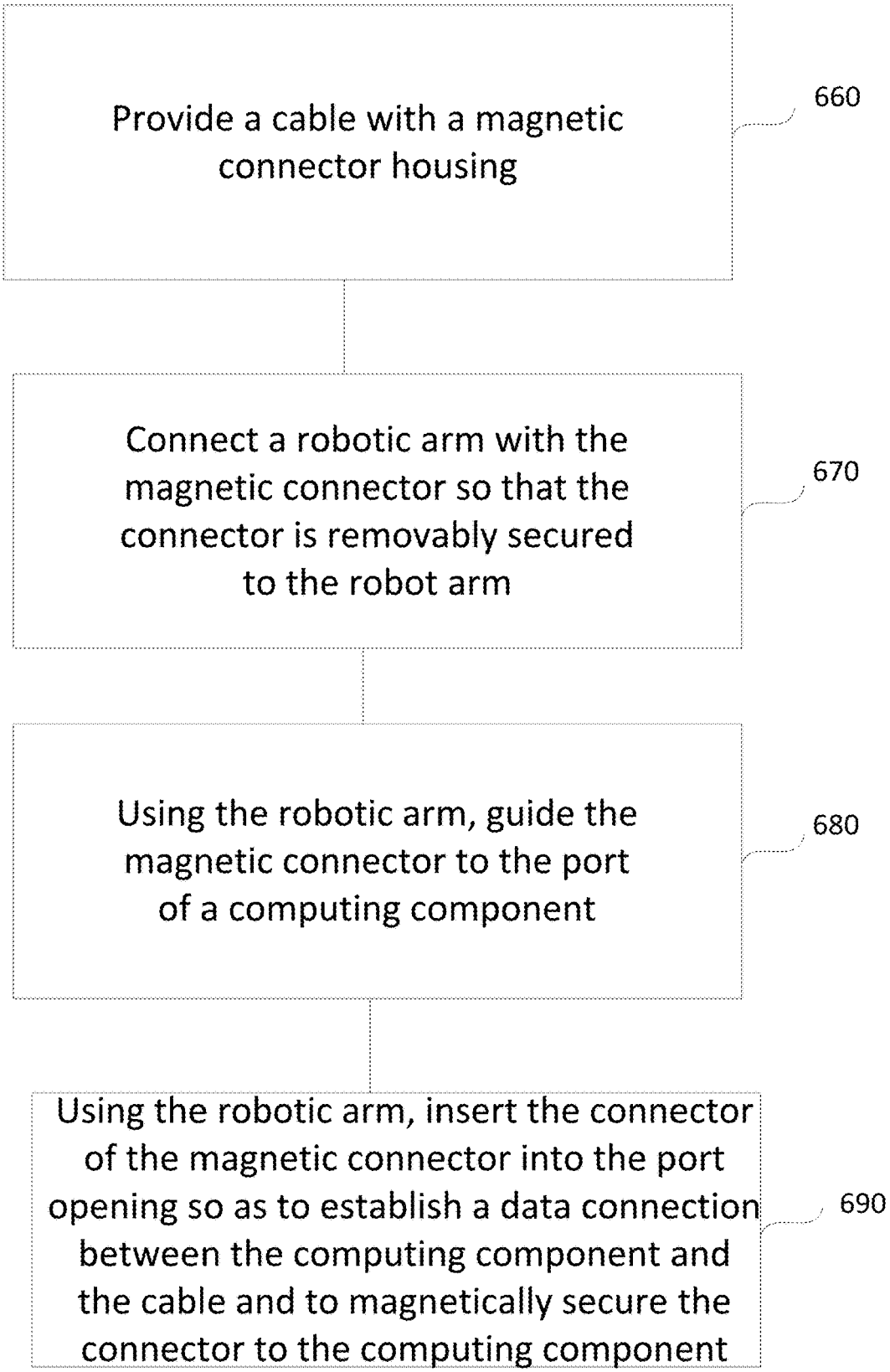
FIG. 16 is a method of automation for securing a magnetic connector to a computing component.

Turning to FIG. 16, an example method 650 for magnetically securing a connector to a port of a computing component and establishing a data connection is shown. At box 660, a cable with a magnetic connector housing, such as magnetic connector 480 disclosed herein, can be provided. At box 670, a robotic arm may be connected with the magnetic connector so that the magnetic connector is removably secured to the robotic arm. At box 680, using the robotic arm, the magnetic connector can be guided to the port of a computing component. At box 690, the magnetic connector may be inserted into the port opening so as to establish a data connection between the computing component and the cable and to magnetically secure the connector to the computing component.

It is to be understood that the figures and descriptions of the present disclosure have been simplified to illustrate elements that are relevant for a clear understanding of the present disclosure, while eliminating, for purposes of clarity, many other elements which are conventional in this art. Those of ordinary skill in the art will recognize that other elements may be desirable for implementing the present disclosure. However, because such elements are well known in the art, and because they do not facilitate a better understanding of the present invention, a discussion of such elements may not be provided herein.

It is noted that the terminology used above is for the purpose of reference only, and is not intended to be limiting. For example, terms such as "upper," "lower," "above," "below," "rightward," "leftward," "clockwise," and "counterclockwise" refer to directions in the drawings to which reference is made. As another example, terms such as "inward" and "outward" may refer to directions toward and away from, respectively, the geometric center of the component described. As a further example, terms such as "front," "rear," "side," "left side," "right side," "top," "bottom," "inner," "outer," "horizontal," and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

While the embodiments disclosed herein have been described in detail, it is evident that many alternatives, modifications, and variations will be apparent to those skilled in the art. Indeed, the disclosure set forth herein includes all possible combinations of the particular features set forth above, whether specifically disclosed herein or not. For example, where a particular feature is disclosed in the context of a particular aspect, arrangement, configuration, or embodiment, that feature can also be used, to the extent possible, in combination with and/or in the context of other particular aspects, arrangements, configurations, and embodiments of the invention, and in the invention generally. Moreover, the disclosure set forth herein includes the mirror image, i.e., mirror configuration, taken from any perspective of any drawing or other configuration shown or described herein. Accordingly, the embodiments of the disclosure as set forth above are intended to be illustrative, not limiting. Various changes may be made without departing from the spirit and scope of the inventions as defined in the following claims.

The invention claimed is:

1. A magnetic adapter for a cable connector, the magnetic adapter comprising:

a main body having an opening for receiving a biasing retention clip of the cable connector, the opening including first and second areas corresponding to first and second portions of the main body;

a first compression surface exposed within the first portion of the opening and configured to compress the biasing retention clip of the cable connector;

a second compression surface exposed within the second portion of the opening and configured to compress the biasing retention clip;

at least one locking surface configured to inhibit movement of the biasing retention clip away from the second portion of the main body and to secure the biasing retention clip in a second non-locking position; and at least one magnet adjacent the opening, wherein when the biasing retention clip is positioned within the first area of the opening, the first compression surface causes the biasing retention clip to move from a first locking position where the retention clip is in a fully biased position to the first non-locking position where the retention clip is compressed, and when the biasing retention clip is moved from the first area to the second area, the biasing retention clip expands and the second compression surface causes the biasing retention clip to be in the second non-locking position.

2. The magnetic adapter of claim 1, wherein the first compression surface includes an angled surface.

3. The magnetic adapter of claim 1, wherein the first area has a first width and the second portion has a second width, the first width being smaller than the second width.

4. The magnetic adapter of claim 1, wherein the main body includes a first end located adjacent the first area and a second end adjacent the second area, wherein the first locking surface faces toward the second end and is configured to engage a rear surface of the retention clip to inhibit movement of the retention clip in a direction toward the first end.

5. The magnetic adapter of claim 4, wherein when the cable connector is positioned within the magnetic adapter, a tip of the cable connector extends beyond the second end of the magnetic adapter.

6. The magnetic adapter of claim 1, wherein the main body of the magnetic adapter is a monolithic structure, and the at least one magnet is disposed within the main body.

7. The magnetic adapter of claim 1, wherein the main body of the magnetic adapter is comprised of at least two components that together form the main body of the magnetic adapter.

8. The magnetic adapter of claim 1, wherein the second area of the second portion has a size that is greater than a size of the first area of the first portion, the size of the second area allowing for the biasing retention clip to expand and move from the first non-locking position to the second non-locking position.

9. The adapter of claim 1, wherein the second compression surface is spaced apart from the first compression surface.

10. The magnetic adapter of claim 1, wherein the second compression surface intersects with the first locking surface.

11. The magnetic adapter of claim 1, further comprising a second locking surface configured to inhibit movement of the biasing retention clip away from the second portion of the main body and to secure the biasing retention clip in the second non-locking position.

12. The magnetic adapter of claim 11, wherein the first and second locking surfaces are positioned in the second portion.

13. The magnetic adapter of claim 12, wherein the first and second locking surfaces are positioned on opposed ends of the second portion of the main body, the first and second locking surfaces configured to engage at least a portion of the retention clip.

14. The magnetic adapter of claim 13, wherein the main body includes a first end located adjacent the first area and a second end adjacent the second area, one of the opposed ends of the second portion being positioned at the second end, wherein the first locking surface faces toward the second end, and the second locking surface faces toward the first end.

15. The magnetic adapter of claim 14, wherein the at least one magnet is positioned at the second end.

16. The magnetic adapter of claim 1, wherein the at least one magnet is two magnets positioned on opposed sides of the opening.

17. The adapter of claim 1, wherein the opening is an enclosed opening, such that the main body extends peripherally around the enclosed opening.

* * * * *